US006978241B1

(12) United States Patent
Sluijter et al.

(10) Patent No.: US 6,978,241 B1
(45) Date of Patent: Dec. 20, 2005

(54) TRANSMISSION SYSTEM FOR TRANSMITTING AN AUDIO SIGNAL

(75) Inventors: Robert Johannes Sluijter, Eindhoven (NL); Augustus Josephus Elizabeth Maria Janssen, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/575,609

(22) Filed: May 22, 2000

(30) Foreign Application Priority Data

May 26, 1999 (EP) ..... 99201656

(51) Int. Cl.[7] ..... G10L 21/04

(52) U.S. Cl. ..... 704/503; 704/241; 704/205; 704/268

(58) Field of Search ..... 704/503, 241, 704/268, 205, 207, 209, 211, 230

(56) References Cited

U.S. PATENT DOCUMENTS 4,937,873 A 6/1990 McAulay et al. ..... 381/51
5,884,253 A 3/1999 Kleijn ..... 704/223

OTHER PUBLICATIONS

Huimin Yang et al: "Pitch synchronous modulated lapped transform of the linear prediction residual of speech" Proceedings of the International Conference on Signal Processing, Oct. 12, 1998, the whole document.

Kleijn W B et al: "Interpolation of Pitch-Predictor Parameters in Analysis-By-Synthesis Speech Coders" IEEE Transactions on Speech and Audio Processing, US, IEEE Inc. New York, vol. 2, No. 1, Part I, 1994, pp. 42-54.

Sluijter R J et al: "A time warper for speech signals" Proceedings of IEEE Workshop on Speech Coding Proceedings. Model, Coders, and Error Criteria, Porvoo, Finland, Jun. 20-23, 1999, pp. 150-152, the whole document.

*Primary Examiner*—Vijay B. Chawan

(57) ABSTRACT

An analyzer determines frequency and amplitudes of an audio signal represented by sinusoids for transmission transmitted to a receiver decoder which includes a synthesizer to reconstruct the audio signal. A pitch detector determines the pitch for transmission to the receiver along with the structure of the spectrum of the speech signal. The structure of the spectrum is often transmitted in the form of LPC parameters. To correct for frequency changes of the periodic component of an audio signal, a frequency change determiner determines a change of the frequency of the periodical component over the analysis period. This change of frequency is transmitted to the decoder for increasing the accuracy of the reconstruction of the audio signal. Further, the frequency change is only used to obtain a more accurate value of the pitch. The frequency change is determined by using a time warper which performs a time transformation such that a time transformed audio signal is obtained with a minimum frequency change.

24 Claims, 3 Drawing Sheets

TRANSMISSION SYSTEM FOR TRANSMITTING AN AUDIO SIGNAL

The present invention relates to a transmission system comprising a transmitter with an encoder for encoding an audio signal, the encoder comprises means for determining a frequency of at least one periodical component, the transmitter further comprises transmitting means for transmitting a signal representing said frequency of at least one periodical component to a receiver, said receiver comprises receiving means for receiving a signal representing said frequency from the transmitter, and a decoder for deriving a reconstructed audio signal on basis of said frequency of the at least one periodical component.

The present invention also relates to a transmitter, a receiver, an encoder, a decoder, a recording system, a reproduction system, an encoding method and a decoding to method, a tangible medium comprising a computer program for performing said method, a signal and a recording medium on carrying such a signal.

A transmission system according to the preamble is known from U.S. Pat. No. 4,937,873.

Such transmission systems and audio encoders are used in applications in which audio signals have to be transmitted over a transmission medium with a limited transmission capacity or have to be stored on storage media with a limited storage capacity. Examples of such applications are the transmission of audio signals over the Internet, the transmission of audio signals from a mobile phone to a base station and vice versa and storage of audio signals on a CD-ROM, in a solid state memory or on a hard disk drive.

Different operating principles of audio encoders have been tried to achieve a good audio quality at a modest bit rate. In one of these operating methods, an audio signal to be transmitted is divided into a plurality of segments having a length of 10–20 ms. In each of said segments the audio signal is represented by a plurality of sinusoids being defined by their amplitude and their frequency. In the encoder the amplitudes and frequencies of the sinusoids are determined.

The transmitting means transmit a representation of the amplitudes and frequencies to the receiver. The operations performed by the transmitter can include, channel coding, interleaving and modulation.

The receiving means receive a signal representing the audio signal from a transmission channel and performs operations like demodulation, de-interleaving and channel decoding. The decoder obtains the representation of the audio signal from the receiver and derives a reconstructed audio signal from it by generating a plurality of sinusoids as described by the encoded signal and combining them into a reconstructed audio signal.

Although the prior art system provides a good coding quality, there still exist an audible difference between the reconstructed audio signal and the original audio signal.

An objective of the present invention is to provide a transmission system according to the preamble in which the quality of the reconstructed audio signal has been further improved.

To achieve said purpose the transmission system according to the invention is characterized in that the encoder further comprises frequency change determining means for determining a frequency change of said at least one periodical component over a predetermined amount of time.

By determining also a frequency change of said at least one periodical component, the quality of the reconstructed audio signal can be improved in two ways. The first way is to transmit the frequency change to the receiver, which can use said frequency change for deriving a reconstructed audio signal. The second way is to use the frequency change to obtain a more accurate value of a frequency of the audio signal. This can e.g. be the pitch in a speech signal, or an arbitrary periodic component in an audio signal. By using the frequency change over a predetermined amount of time, an average frequency value which corresponds to said fundamental frequency, can be determined more accurately.

An embodiment of the invention is characterized in that the transmitting means are arranged for transmitting a further signal representing said frequency change to the receiver, in that the receiver is arranged for receiving said further signal, and in that the decoder is arranged for deriving said reconstructed audio signal also on basis of said change of said frequency.

By representing the frequency change by an additional signal that is transmitted to the receiver, it becomes possible that sinusoids that change (slightly) in frequency within one synthesis interval are used in generating the reconstructed audio signal. This corresponds more to the properties of the actual audio signal, resulting in an improved quality of the reconstructed audio signal.

A further embodiment of the invention is characterized in that the encoder comprises time transforming means for obtaining a time transformed input signal, wherein the time transforming means are arranged for time compressing the input signal during a first part of the predetermined amount of time and for time expanding the input signal during a second part of the predetermined amount of time in such a way that the time transformed input signal has a smaller frequency change than the input signal.

The use of time transformation, also called time warping, to obtain a time transformed audio signal, has been proven to be an effective way for dealing with frequency changes of the signal to be encoded. By using an appropriate time transformation it becomes possible to transform a signal that changes in frequency into a time transformed signal which has a substantially constant frequency.

An example of this is an audio signal with a linear frequency sweep starting at a low frequency at the beginning of a segment and ending at a higher frequency at the end of the segment. By time compressing the input signal in the first part of the segment, the frequency of the time-transformed signal will be higher than the frequency of the original input signal. By time expanding the input signal in the second part of the segment, the frequency of the time-transformed signal input signal will be lower than the frequency of the original input signal.

Consequently, a time transformed input signal is obtained of which the frequency in the beginning of the segment has been increased and of which the frequency at the end of the segment has been decreased. If a suitable choice of the time transform is made, it becomes possible to obtain a transformed input signal having a decreased frequency change.

A still further embodiment of the invention is characterized in that the time transform determining means are arranged for deriving a plurality of time transformed input signals, each corresponding to a different time transform, and in that the encoder comprises determining means for selecting the time transform corresponding to the time transformed input signal having the smallest frequency change over said predetermined amount of time.

A way of determining the most suitable time transform is to try a number of different time transforms and select the one resulting in a transformed audio signal having the smallest frequency change.

A still further embodiment of the invention is characterized in that the time transform determining means are arranged for selecting the time transformed input signal having the smallest frequency change over said predetermined amount of time by selecting the time transformed input signal having the highest peak in its autocorrelation function.

A useful way of determining the transformed time signal with the smallest frequency change is to calculate the auto-correlation function of the different time transformed input signals. The time-transformed audio signal having the highest peak in its auto-correlation function has the smallest frequency change. Alternatively, it is also possible to calculate the FFT of the time transformed input signal. Then the time transformed audio signal resulting in the highest peak in the FFT domain has the most constant frequency.

A still further embodiment of the transmission system according to the invention is characterized in that the time transform is defined by a quadratic relation between the actual time and the transformed time.

A quadratic relation between the actual time and the transformed time can be easily calculated, and is able to achieve time compression in a first part of the time segment and time expansion in a second part of the time segment.

A still further embodiment of the transmission system according to the invention is characterized in that the relation between the actual time t and the transformed time τ is defined by $$\tau(t) = \frac{a}{T} \cdot t^2 + (1 - a) \cdot t;$$

$0 \leqq t \leqq T$ in which a is a parameter defining the time transform and T is the duration of a signal segment.

The above quadratic time transform has only one parameter and is still able to obtain time compression and time expanding during one signal segment. The advantage of having only one parameter is the reduced number of bits that is required to transmit the optimum time transform to the transmitter. Further it can be shown that this time transform function is able to completely eliminate a linear frequency change of the input signal.

The invention will now be explained with reference to the drawings.

FIG. 2 shows a graph of a time transform function for several values of the parameter a.

Figure 1:
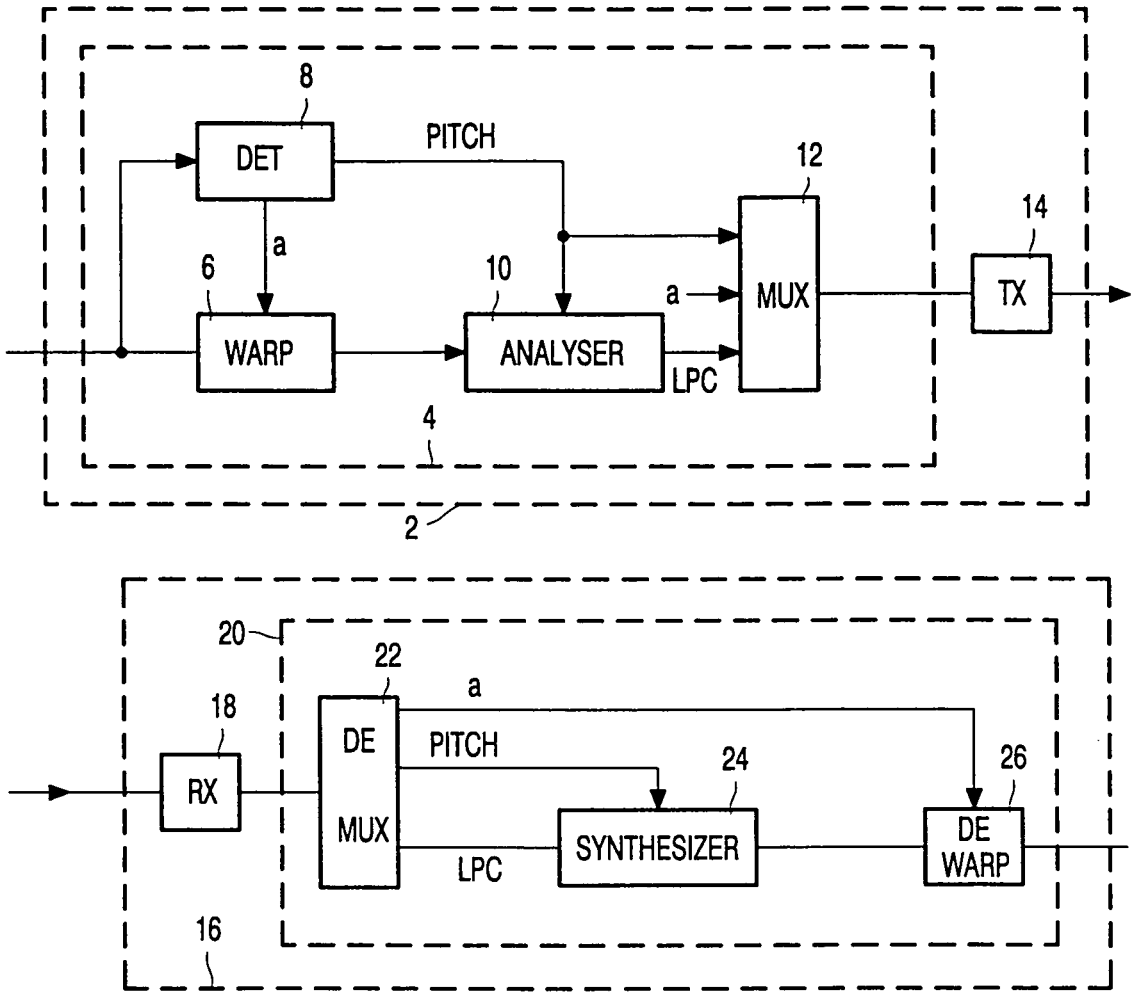
FIG. 1 shows a transmission system according to the invention for transmitting an audio signal.

In the transmission system according to FIG. 1, an audio signal to be transmitted is applied to an input of an audio encoder 4 included in a transmitter 2. In the audio encoder 4 the input audio signal is applied to an input of frequency change determining means 8 and to an input of the time transform means which is here a time warper 6.

A first output signal of the frequency change determining means 8, carrying an output signal a, is connected to a control input of the time warper 6. The output signal a represents a frequency change of a periodical component of the input signal. The time warper 6 performs a time transformation defined by the parameter a on its input signal. The parameter a is selected such that the frequency of a periodical component in the output signal of the time warper 6 is minimized.

At a second output of the frequency change determining means 8 a signal PITCH, representing an average frequency of the periodical component in the audio signal, is presented. In speech coding the signal PITCH represents the pitch of the speech signal.

The output of the time warper 6 is connected to an input of an analyzer 10 which is arranged for determining parameters representing the output signal of the time warper 6. A first possibility is that the analyzer 10 is a linear predictive analyzer, which determines a plurality of LPC coefficients of the input signal, such as LAR's (Log Area Ratios) or LSP's (Line Spectral Pairs). Alternatively it is also possible that the analyzer 10 determines directly the amplitudes and frequencies of a plurality of sinusoidal components present in the output signal of the time warper 6.

The signal a, the signal PITCH and the output signal of the analyzer 10 representing additional properties of the audio signal (LPC coefficients or amplitude and frequency of sinusoids) are applied to corresponding inputs of a multiplexer 12. An output of the multiplexer 12 is connected to an input of the transmitting means 14 which transmit the output signal of the multiplexer 14 to a receiver 16.

The transmit means 14 perform operations like channel encoding, interleaving and modulating the signal to be transmitter on an RF carrier. In case the present invention is used for recording the encoded audio signal on a recording medium such as a hard drive or an optical disk (CD, DVD) the modulation step can be dispensed with. In such cases often a modulation code is used to shape the spectrum of the signal to be written on the recording medium.

In the receiver 16, the signal received from the transmitter 2 is first processed by the receiving means 18. The receiving means 18 are arranged for performing demodulation, de-interleaving and channel decoding. The output signal of the receiving means 18 is connected to an input of a decoder 20. In the decoder 20, the output signal of the receiving means 18 is connected to an input of a demultiplexer 22.

The demultiplexer provided output signals a, PITCH and LPC at its outputs. The signals PITCH and LPC are used in the synthesizer 24 that derives a reconstructed audio signal from these parameters. The operation of a such a synthesizer which derives a reconstructed audio signal on basis of a pitch signal and a plurality of LPC parameters is described in detail in the International Patent Application WO99/03095-A1.

The output of the synthesizer 24 is connected to an input of the inverse time transform means which are here a de-warper 26. The de-warper 26 re-introduces the frequency variations that were removed from the input signal by the time warper 6. At the output of the dewarper 26 the reconstructed audio signal is available.

A suitable time transform function to be used in the time warper 6 is given by:

$$\tau(t) = \frac{a}{T} \cdot t^2 + (1 - a) \cdot t; 0 \leq t \leq T \quad (1)$$

In (1) a is a warping parameter, T is the duration of the speech segment, t represents the real time and $\tau$ is the transformed time. The value of the warping parameter a has a range that ensures that the warping function always increases with time t. This leads to:

$$|a| \leq 1 \tag{2}$$

The warping function is chosen such that the total duration of the warped audio segment is equal to the duration of the original audio segment. The start and end values of the warped segment are equal to the start and end values of the original audio segment.

Whether time compression or time expansion takes place can be determined by differentiating (1) with respect to t. This results into:

$$\frac{d\tau}{dt} = 2a\frac{t}{T} + (1-a) \tag{3}$$

Time compression takes place when $d\tau/dt$ is smaller than 1 and time expansion takes place when $d\tau/dt$ is larger than 1. From (3) follows that time compression takes place for $t<T/2$ and time expansion takes place for $t>T/2$ when $a>0$. Time compression takes place for $t>T/2$ and time expansion takes place for $t<T/2$ when $a<0$.

The inverse of the time warping function according to (1) is defined according to:

$$t(\tau) = \begin{cases} \tau, & a = 0 \\ \frac{(a-1)}{2a}T + \frac{T}{2a}\sqrt{(a-1)^2 + 4\frac{a\cdot\tau}{T}}, & 0 < |a| \leq 1 \end{cases} \tag{4}$$

Figure 2:
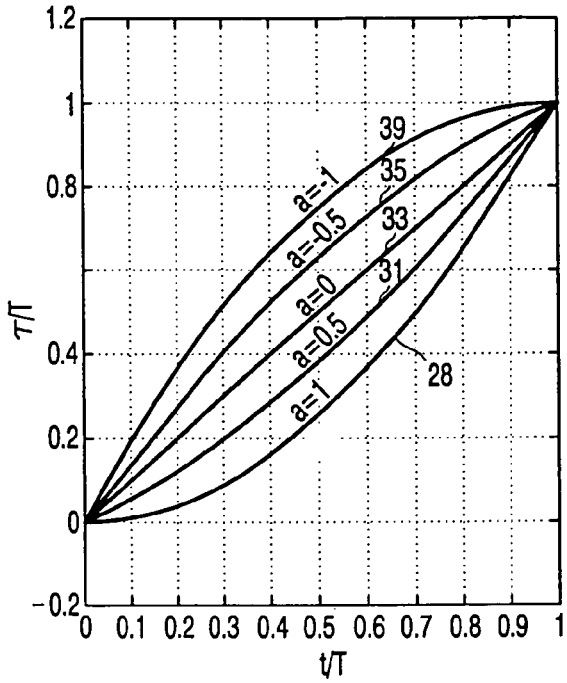

FIG. 2 shows $\tau/T$ as function of $t/T$ for different values of a. If a is equal to 0, $\tau$ is equal to t and no time warping takes place.

In the following the operation of the time warper defined by (1) will be analyzed. If the signal s(t) is a signal with a time varying periodicity, like voiced speech, this can be written as:

$$s(t) = \sum_k \{x_k \cos k\Phi(\tau) + y_k \sin k\Phi(\tau)\} \tag{5}$$

In (5) k is the harmonic number, $X_k$ and $Y_k$ are amplitude factors, and $\Phi(t)$ is a phase angle. For the time transformed signal $s'(\tau)$ can be written:

$$s'(\tau) = \sum_k \{x_k \cos k\Psi(\tau) + y_k \sin k\Psi(\tau)\} \tag{6}$$

As (5) and (6) represent the same physical signals, $\Phi(t)$ is equal to $\Psi(\tau)$. The instantaneous angular frequency $\omega_k(t)$ of the $k^{th}$ harmonic of s(t) is given by:

$$\omega_k(t) = k\frac{d\Phi(t)}{dt} \tag{7}$$

For the instantaneous angular frequency $\Omega_k(\tau)$ of the $k^{th}$ harmonic of $s'(\tau)$ can be found:

$$\Omega_k(\tau) = k\frac{d\Psi(\tau)}{d\tau} \tag{8}$$

Because $\Phi(t)=\Psi(\tau)$, their derivatives with respect to time t are also equal. Using the chain rule, this can be written as:

$$\frac{d\Phi(t)}{dt} = \frac{d\Psi(\tau)}{dt} = \frac{d\Psi(\tau)}{d\tau}\frac{d\tau}{dt} \tag{9}$$

For the relation between $\Omega_k(\tau)$ and $\omega_k(t)$ can be found by using (9):

$$\Omega_k(\tau) = \frac{\omega_k}{\frac{d\tau}{dt}} \tag{10}$$

Another important property of the time warper is that the average frequency of the $k^{th}$ harmonic of the warped signals is equal to the average frequency of the $k^{th}$ harmonic of the original signal. This follows easily from:

$$\overline{\Omega}_k = \frac{1}{T}\int_0^T \Omega_k(\tau)d\tau = \frac{1}{T}\int_0^T \frac{\omega_k(t)}{\frac{d\tau}{dt}}d\tau = \int_0^T \omega_k(t)dt = \overline{\omega}_k \tag{11}$$

Below will be shown that the above time warping function is able to remove linear frequency variations from the input signal.

Substituting (3) into (10) results into:

$$\Omega_k(\tau) = \frac{\omega_k(t)}{1 - a + \frac{2a}{T}t} \tag{12}$$

Assume an input signal having sinusoidal input signal having an angular frequency $\omega(t)$ that changes linearly over time. For the angular frequency of this signal can be written:

$$\omega(t) = \alpha + \beta\frac{t}{T} \tag{13}$$

Substituting (13) into (12) gives:

$$\Omega(\tau) = \frac{\alpha + \beta\frac{t}{T}}{1 - a + \frac{2a}{T}t} \tag{14}$$

If $\Omega(\tau)$ should be constant, the following should be valid:

$$\frac{\alpha}{1-\hat{a}} = \frac{\beta}{2\hat{a}} \Longrightarrow \hat{a} = \frac{\beta}{\beta + 2a} \tag{15}$$

Substituting (15) into (14) results into:

$$\hat{\Omega} = \Omega(\tau)\Big|_{a=\hat{a}} = \alpha + \frac{\beta}{2} \tag{16}$$

This corresponds to a constant value that is equal to the average of the angular frequency $\omega(t)$ over the segment with duration T.

Figure 3:
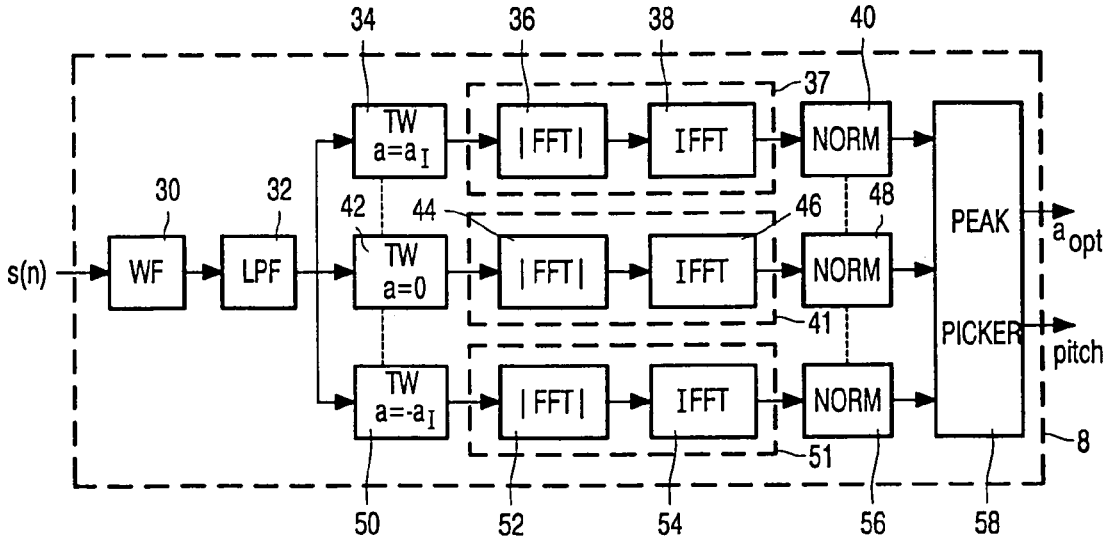
FIG. 3 shows an embodiment of the transform determining means 8 used in the transmission system according to FIG. 1.

In the frequency change determining means 8 according to FIG. 3, the audio signal is first applied to a weighting filter 30. This weighting filter 30 is an adaptive LPC inverse filter. The output signal of the weighting filter 30 is an LPC residual. Using the prediction residual instead of the input signal has as advantage that is minimizes the formant interaction with the determination of the frequency of the fundamental frequency (pitch).

The output of the weighting filter 30 is connected to an input of a low pass filter 32. This low pass filter has a cut-off frequency of about 1100 Hz. The output of the low pass filter 32 is connected to inputs of a plurality of time warpers 34, 42 and 50. The time warpers 34, 42 and 50 are arranged for performing a time transformation according to (1), but each with a different value of the parameter a.

The output of the time warpers 34, 42 and 50 are connected to inputs of correlators 37, 41 and 51, which each determine a measure which is an approximation of the autocorrelation function of the output signal of the corresponding time warper.

The correlators 37, 41 and 51 use the property that the autocorrelation function can be determined by calculating the inverse FFT from the power spectrum of the signal under analysis. As an approximation of the power spectrum also the absolute value of the Fast Fourier Transform can be used. The analysis window is given a relatively long duration of 64 msec in order to deal with very long pitch periods (up to 25 msec) which can occur in some male voices. The choice of this long analysis window becomes possible due to the time warping operation, which delivers a more stationary time transformed signal.

The input signal of the correlators 37, 41 and 51 is subjected to a Fourier transform in the Fourier transformers 36, 44 and 52. These Fourier transformers determine the absolute value of the FFT of their input signals. Subsequently, a so-called "zero phase function" $z_i(n)$ of the output signals of the Fast Fourier transformers 36, 44 and 52 is determined by calculating the inverse FFT of the amplitude spectrum by means of Inverse Fast Fourier Transformers 38, 46 and 54.

The zero phase functions $z_i(n)$ are normalized with respect to their value $z_i(0)$ in the normalizers 40, 48 and 56. The outputs of the normalizers 40, 48 and 56 are connected to the inputs of the selection means 58 which selects the time warping parameter a that corresponds to the zero phase function having the highest peak for a non-zero value of n as the optimum value. This is based on the recognition that an optimally warped signal shows the most constant frequency $\Omega_k(\tau)$. Consequently, this signal has the largest peak in its autocorrelation function.

The time warpers and dewarpers are up to now described as continuous time operations. In a real implementation, these operations should be implemented in a discrete time system. If a segment of the input signal with duration T is represented by N samples, the warped segment has also duration T and should also be represented by N samples. However, the sampling instants of the time warped signal do not correspond to sampling instants of the original input signal. This is shown for a time warper in FIG. 5 and for a time de-warper in FIG. 6.

Figure 4:
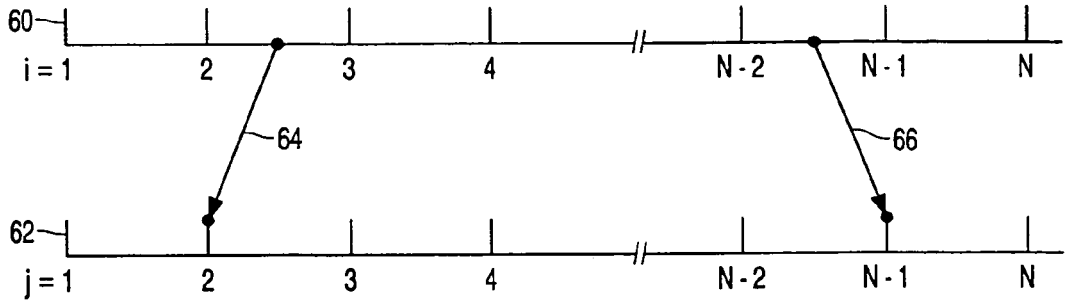
FIG. 4 shows graphs of discrete time signals involved with the time transform by the time warper 6 according to FIG. 1.
Figure 5:
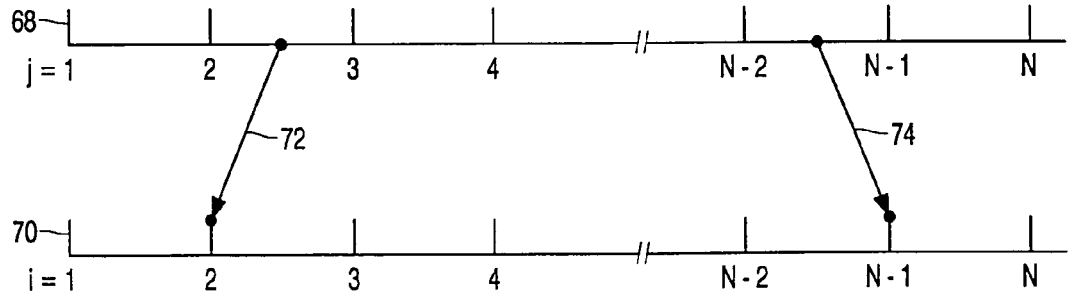
FIG. 5 shows graphs of discrete time signals involved with the inverse time transform by the time de-warper 26 according to FIG. 1.

In FIG. 5 graph 60 corresponds to the input signal and graph 62 corresponds to the warped output signal. As is shown by the arrow 64 in FIG. 4, the sampling instant j=2 in graph 62 corresponds to a time between the sample instants i=2 and i=3 in graph 60. This corresponds to a time compression. As is shown by the arrow 66 in FIG. 4, the sampling instant j=N−1 in graph 62 corresponds to a time between the sample instants N−2 and N−1 in graph 60. This corresponds to a time expansion.

To deal with this problem, sample values have to be calculated for each of the occurring values of $\tau_j$, which are given by:

$$\tau_j = j \cdot \frac{T}{N};\ 1 \le j \le N \tag{17}$$

This is done by calculating from $\tau_j$ a corresponding value of t by using (4). From this value of t the nearest values on the sampling grid are determined. This results into two values of i according to:

$$i_1 = \left\lfloor N \cdot \frac{t}{T} \right\rfloor \qquad i_2 = \left\lceil N \cdot \frac{t}{T} \right\rceil \tag{18}$$

In (18) $\lfloor\ \rfloor$ represent the nearest integer smaller than its argument, and $\lceil\ \rceil$ represents the nearest integer larger than its argument. Finally, a linearly interpolated sample value for $\tau_j$ is calculated according to:

$$s(\tau_j) = s(i_1)\cdot\left(N \cdot \frac{t}{T} - i_1\right) + s(i_2)\cdot\left(1 - N \cdot \frac{t}{T} + i_1\right) \tag{19}$$

It is observed that, besides linear interpolation, also other types of interpolation such as quadratic and cubic interpolation can be used.

Graph 68 in FIG. 5 shows the warped time-scale and graph 70 shows the corresponding unwarped time scale.

The inverse warping can be done in a similar way as is shown in FIG. 5. First, the values of $t_i$ for which the corresponding samples have to be determined are found by $$\tau_i = i \cdot \frac{T}{N};\ 1 \le i \le N \tag{20}$$

Now the calculation continues with determining the value of $\tau$ corresponding to a given $t_i$ as is indicated by the arrows 72 and 74 by using the expression (1). From this value of t the nearest values on the sampling grid are determined. This results into two values of j according to:

$$j_1 = \left\lfloor N \cdot \frac{\tau}{T} \right\rfloor \qquad j_2 = \left\lceil N \cdot \frac{\tau}{T} \right\rceil \tag{21}$$

Finally, a linearly interpolated sample value for $t_i$ is calculated according to:

$$s(t_i) = s(j_1) \cdot \left(N \cdot \frac{\tau}{T} - j_1\right) + s(j_2) \cdot \left(1 - N \cdot \frac{\tau}{T} + j_1\right) \tag{22}$$

It is observed that the present invention can be implemented by using dedicated hardware or by using a program which runs on a programmable processor. Also it is conceivable that a combination of these implementations is used.

What is claimed is:

1. Transmission system comprising a transmitter with an encoder for encoding an audio signal, the encoder comprises frequency determining means for determining a frequency of at least one periodical component of the audio signal, the transmitter further comprises transmitting means for transmitting a signal representing said frequency to a receiver, said receiver comprises receiving means for receiving a signal representing said frequency from the transmitter, and a decoder for deriving a reconstructed audio signal on the basis of said frequency, wherein the encoder further comprises frequency change determining means for determining a rate of frequency change of said at least one periodical component of the audio signal over a predetermined amount of time to be used by said decoder for deriving said reconstructed audio signal, wherein the frequency change determining means further determines an average frequency of the at least one periodical component of the audio signal over the predetermined amount of time to be used by said decoder for deriving said reconstructed audio signal, wherein the transmitting means transmits two further signals representing, respectively, said frequency change to the receiver and said average frequency of the at least one periodical component, and the receiver receives said further signal, the decoder deriving said reconstructed audio signal also on basis of said frequency change.

2. Transmission system according to claim 1, wherein the encoder comprises means for determining a fundamental frequency from the audio signal using said frequency change.

3. Transmission system according to claim 1, wherein the encoder comprises time transforming means for obtaining a time transformed audio signal, wherein the time transforming means are arranged for time compressing the audio signal during a first part of the predetermined amount of time and for time expanding the audio signal during a second part of the predetermined amount of time in such a way that the time transformed audio signal has a smaller frequency change than the audio signal.

4. Transmission system according to claim 3, wherein the time transform is defined by a quadratic relation between the actual time and the transformed time.

5. Transmission system according to claim 4, wherein the relation between the actual time t and the transformed time $\tau$ is defined by $$\tau(t) = \frac{a}{T} \cdot t^2 + (1 - a) \cdot t;$$

$0 \leqq t \leqq T$ in which a is a parameter defining the time transform and T is the duration of a signal segment.

6. Transmission system according to claim 1, wherein the frequency change determining means comprise time transform determining means for deriving a plurality of time transformed audio signals, each corresponding to a different time transform, and wherein the time transform determining means comprise selection means for selecting the time transform corresponding to the time transformed audio signal having a smallest frequency change over said predetermined amount of time.

7. Transmission system according to claim 6, wherein the time transform determining means are arranged for selecting the time transformed audio signal having the smallest frequency change over said predetermined amount of time by selecting the time transformed audio signal having the highest peak in its autocorrelation function.

8. Transmitter with an encoder for encoding an audio signal, the encoder comprises frequency determining means for determining a frequency of at least one periodical component of the audio signal, the transmitter further comprises transmitting means for transmitting a signal representing said frequency, wherein the encoder further comprises frequency change determining means for determining a rate of frequency change of said at least one periodical component of the audio signal over a predetermined amount of time to be used by a decoder for deriving said reconstructed audio signal, wherein the frequency change determining means further determines an average frequency of the at least one periodical component of the audio signal over the predetermined amount of time to be used by said decoder for deriving said reconstructed audio signal, wherein the transmitting means transmits two further signals representing, respectively, said frequency change and said average frequency of the at least one periodical component.

9. Transmitter according to claim 8, wherein the encoder comprises means for determining a fundamental frequency from the audio signal under use of said change of said fundamental frequency over a predetermined amount of time.

10. Transmitter according to claim 8, wherein the encoder comprises time transforming means for obtaining a time transformed audio signal, wherein the time transforming means are arranged for time compressing the audio signal during a first part of the predetermined amount of time and for time expanding the audio signal during a second part of the predetermined amount of time in such a way that the time transformed audio signal has a smaller frequency change than the audio signal.

11. Receiver comprising receiving means for receiving an encoded audio signal representing an audio signal by at least a frequency of at least one periodical component of the audio signal, and a decoder for deriving a reconstructed audio signal on the basis of said frequency, wherein the receiver receives two further signals representing, respectively, a rate of frequency change of said at least one periodical component of said audio signal over a predetermined amount of time, and an average frequency of the at least one periodical component of the audio signal, and the decoder is arranged for deriving said reconstructed audio signal also on the basis of said frequency change and said average frequency.

12. Receiver according to claim 11, wherein the decoder comprises time transforming means for obtaining the reconstructed audio signal by time transforming a decoded signal wherein the time transforming means are arranged for time expanding the decoded signal during a first part of the predetermined amount of time and for time compressing the decoded signal during a second part of the predetermined amount of time in such a way that the time transformed decoded signal has a larger frequency change than the decoded signal.

13. Encoder for encoding an audio signal, the encoder comprises means for determining a frequency of at least one periodical component of the audio signal, and for deriving a signal representing said frequency, wherein the encoder further comprises frequency change determining means for determining a first further signal representing a rate of frequency change of said at least one periodical component over a predetermined amount of time, wherein the frequency change determining means further determines a second further signal representing an average frequency of the at least one periodical component of the audio signal over the predetermined amount of time to be used by said decoder for deriving said reconstructed audio signal, wherein said first and second further signals are transmitted to a decoder for deriving said audio signal from said first and second further signals.

14. Encoder according to claim 13, wherein the encoder comprises time transforming means for obtaining a time transformed audio signal, wherein the time transforming means are arranged for time compressing the audio signal during a first part of the predetermined amount of time and for time expanding the audio signal during a second part of the predetermined amount of time in such a way that the time transformed audio signal has a smaller frequency change than the audio signal.

15. Decoder for deriving a reconstructed audio signal from an encoded audio signal representing said audio signal by at least a frequency of at least one periodical component of the audio signal, said decoder deriving the reconstructed audio signal on the basis of said frequency, wherein the decoder drives said reconstructed audio signal also on the basis of two further signals representing, respectively, a rate of frequency change of said at least one periodical component over a predetermined amount of time and an average frequency of the at least one periodical component of the audio signal over the predetermined amount of time, said two further signals being received from a transmitter.

16. Decoder according to claim 15, wherein the decoder comprises time transforming means for obtaining the reconstructed audio signal by time transforming a decoded signal wherein the time transforming means are arranged for time expanding the decoded signal during a first part of the predetermined amount of time and for time compressing the decoded signal during a second part of the predetermined amount of time in such a way that the reconstructed audio signal has a larger frequency change than the decoded signal.

17. Method for encoding an audio signal comprising determining a frequency of at least one periodical component, deriving a signal representing said frequency of at least one periodical component of the audio signal, and determining two further signals representing, a rate of frequency change of said at least one periodical component of the audio signal over a predetermined amount of time and an average frequency of the at least one periodical component of the audio signal over the predetermined amount of time, said to be used by a decoder for deriving said audio signal, wherein said signal and said two further signals are transmitted to a decoder for deriving said audio signal from said signal and said two further signals.

18. Method according to claim 17, further comprising deriving a time transformed audio signal, and time compressing the audio signal during a first part of the predetermined amount of time and for time expanding the audio signal during a second part of the predetermined amount of time in such a way that the time transformed audio signal has a smaller frequency change than the audio signal.

19. Storage medium carrying a computer program for performing a method according to claim 17.

20. Storage medium carrying an encoded audio signal according to claim 19.

21. Signal carrying a computer program for performing a method according to claim 17.

22. Method for deriving a reconstructed audio signal from an encoded audio signal representing an audio signal by at least a frequency of at least one periodical component of the audio signal, and a decoder for deriving said reconstructed audio signal on basis of a frequency signal representing said frequency, wherein the method comprises deriving said reconstructed audio signal also on basis of two further signals representing, respectively, a rate of frequency change of said at least one periodical component of the audio signal over a predetermined amount of time and an average frequency of the at least one periodical component of the audio signal over the predetermined amount of time, wherein said frequency signal and said two further signals are transmitted to said decoder for deriving said audio signal from said frequency signal and said two further signals.

23. Method according to claim 22, further comprising deriving the reconstructed audio signal by a time transforming of a decoded signal wherein the time transforming comprises time expanding the decoded signal during a first part of the predetermined amount of time and for time compressing the decoded signal during a second part of the predetermined amount of time in such a way that the time transformed decoded signal has a larger frequency change than the decoded signal.

24. Encoded audio signal representing said audio signal by at least a frequency of at least one periodical component of the audio signal, wherein the encoded audio signal comprises a first further signal component representing a rate of frequency change of said at least one periodical component over a predetermined amount of time and a second further signal representing an average frequency of the at least one periodical component of the audio signal over the predetermined amount of time, wherein said first and second further signals are transmitted to a decoder for deriving said audio signal from said two further signals.

* * * * *